United States Patent [19]

Yamamoto et al.

[11] Patent Number: 4,673,381

[45] Date of Patent: Jun. 16, 1987

[54] CARTONING MACHINE HAVING AUXILIARY FLAP SEALER

[75] Inventors: Hisashi Yamamoto; Yukio Konaka, both of Kanazawa, Japan

[73] Assignee: Shibuya Kogyo Co., Ltd., Kanazawa, Japan

[21] Appl. No.: 838,496

[22] Filed: Mar. 11, 1986

Related U.S. Application Data

[63] Continuation of Ser. No. 624,869, Jun. 27, 1984.

[30] Foreign Application Priority Data

Jul. 6, 1983 [JP] Japan ..... 58-122975

[51] Int. Cl.[4] ..... B31B 1/36; B31B 1/52; B31B 1/62

[52] U.S. Cl. ..... 493/128; 493/31; 493/34; 493/132; 493/141; 493/142; 493/151; 493/337; 53/374

[58] Field of Search ..... 493/31, 34, 70, 80, 493/128, 130, 131, 132, 141, 142, 151, 156, 178, 180, 183, 453, 336, 337; 53/374

[56] References Cited

U.S. PATENT DOCUMENTS

| | | | |
|---|---|---|---|
| 2,438,788 | 3/1948 | Palmer | 493/337 |
| 3,323,285 | 6/1967 | Hagedorn | 53/374 |
| 3,504,478 | 4/1970 | Dieter | 53/580 |
| 3,751,876 | 8/1973 | Oakley et al. | 493/142 |
| 3,902,406 | 9/1975 | Reichert | 493/132 |
| 4,480,421 | 11/1984 | Rece | 53/75 |
| 4,515,581 | 5/1985 | Molitor et al. | 493/453 |
| 4,526,563 | 7/1985 | Froom | 493/151 |
| 4,574,561 | 3/1986 | Dirico | 493/132 |

*Primary Examiner*—Frederick R. Schmidt
*Assistant Examiner*—William E. Terrell
*Attorney, Agent, or Firm*—Steven F. Caserza; Alan H. MacPherson; Edel M. Young

[57] ABSTRACT

Apparatus for adhesively affixing together flaps of a container box includes a conveyor belt on which the box is carried, a glue applicator for applying glue to at least one of the flaps, a main flap folding unit for folding the flaps together during normal operation and an auxiliary flap folding unit which is held inoperative during normal operation but which is set in operation when the conveyor belt is brought to a halt.

1 Claim, 11 Drawing Figures

CARTONING MACHINE HAVING AUXILIARY FLAP SEALER

This application is a continuation of application Ser. No. 06/624,869, filed June 27, 1984.

BACKGROUND OF THE INVENTION

1. Field of the Invention

This invention generally relates to a cartoning machine and particularly to a flap gluing apparatus for applying glue to and fixing flaps of a carton.

2. Description of the Prior Art

A container box, such as a carton, generally includes a rectangular main body comprised of four side walls and four flaps each formed at one end of a corresponding one of the four side walls. When closing such a container box in accordance with the prior art machine, while transporting the container box on a conveyor belt, glue is applied to the flaps by a glue applying unit and then the flaps are folded together by a flap folding unit disposed downstream of the glue applying unit with respect to the advancing direction of the conveyor belt. Such glue applying and flap folding units are spaced apart from each other in the advancing direction of the conveyor belt in a carton processing line. However, since there are also provided other units in the carton processing line upstream and downstream of the glue applying and flap folding units, it sometimes occurs that the conveyor belt is temporarily brought to a halt, for example, due to malfunctioning of other units. In such a case, those container boxes located between the glue applying and flap folding units have flaps to which glue has already been applied but which have not yet been folded or affixed together. When the conveyor belt is again set in operation, those container boxes move past the flap folding unit; however, since the glue applied to the flaps is most likely dried and hardened, the flaps cannot be affixed together even if the flaps are folded together by the flap folding unit. Thus, those container boxes must be removed from the conveyor at the downstream side.

SUMMARY OF THE INVENTION

It is therefore a primary object of the present invention to obviate the disadvantages of the prior art as described above and to provide an improved cartoning system.

Another object of the present invention is to provide an improved flap gluing apparatus for gluing together flaps of a container box, such as a carton.

A further object of the present invention is to provide an improved flap gluing apparatus for applying glue to flaps of a container box and folding the flaps thus glued together to have the flaps affixed together securely under various operating conditions.

A still further object of the present invention is to provide an improved flap gluing apparatus particularly suitable for use in a carton processing system.

A still further object of the present invention is to provide an improved flap gluing apparatus capable of affixing the flaps of a container box, such as a carton, together without failure even if the transportation of the container boxes to be processed is temporarily halted.

Other objects, advantages and novel features of the present invention will become apparent from the following detailed description of the invention when considered in conjunction with the accompanying drawings.

DESCRIPTION OF THE PREFERRED EMBODIMENTS

Figure 1:
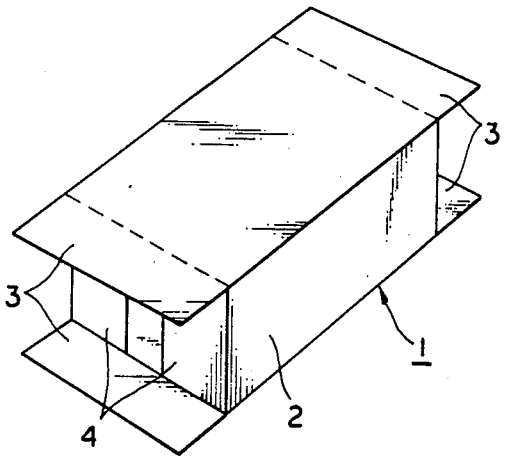
FIG. 1 is a perspective view showing an example of a container box whose flaps are not yet affixed together.

Referring now to FIG. 1, there is shown a container box 1, such as a carton, which includes a main body 2 comprised of four side walls in the form of a rectangular duct and flaps 3, 4 each of which is foldably provided at one end of each of the side walls. In the illustrated example, the side flaps 4 have already been folded in position, and, thus, in this case, glue is applied to the side flaps 4 in position and then the top and bottom flaps 3 are folded to be pressed against and thus affixed to the side flaps 4 according to the flap gluing or affixing apparatus of the present invention.

Figure 2:
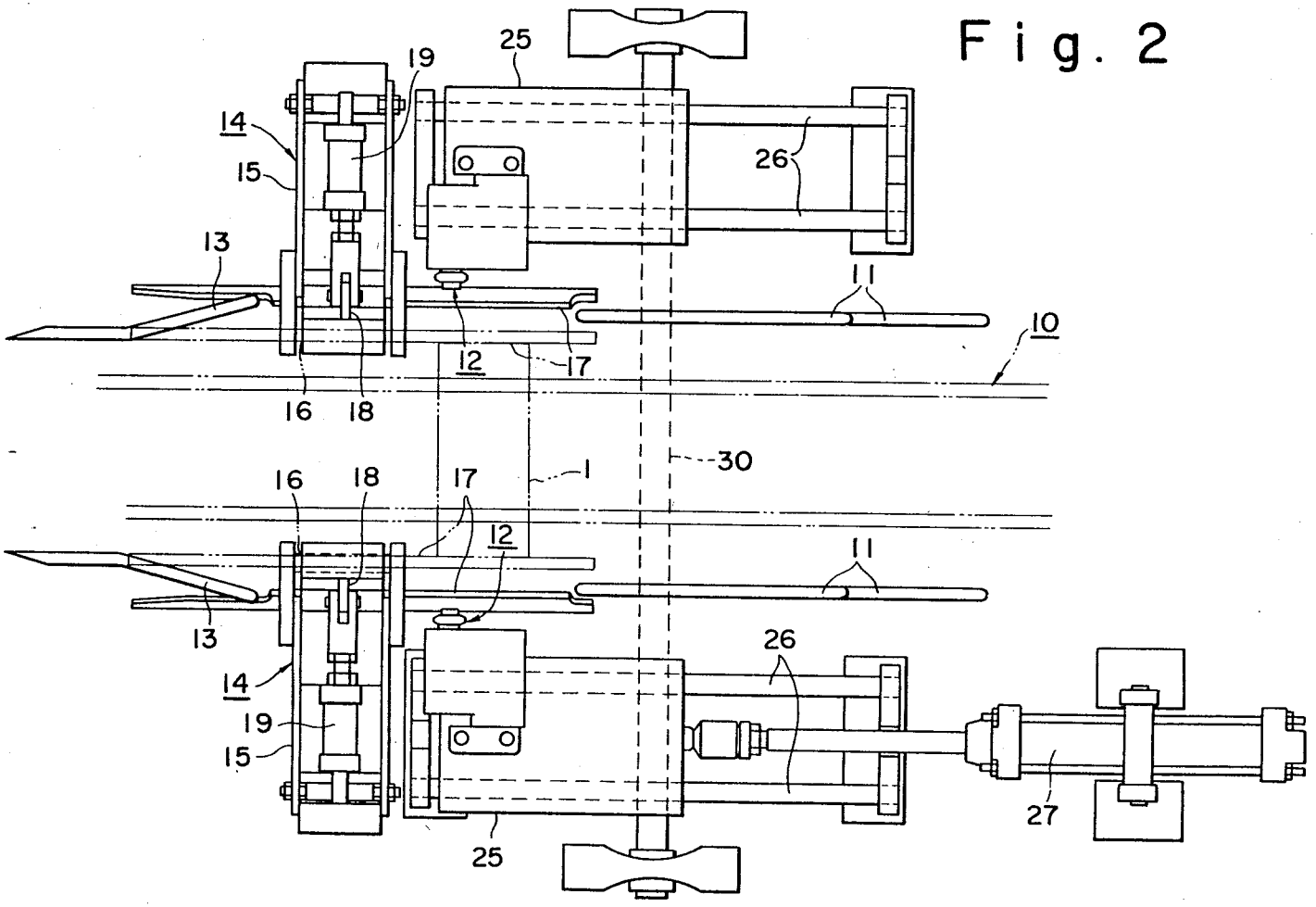
FIG. 2 is a plan view showing the flap gluing apparatus constructed in accordance with one embodiment of the present invention for affixing together the flaps of the container box shown in FIG. 1.
Figure 3:
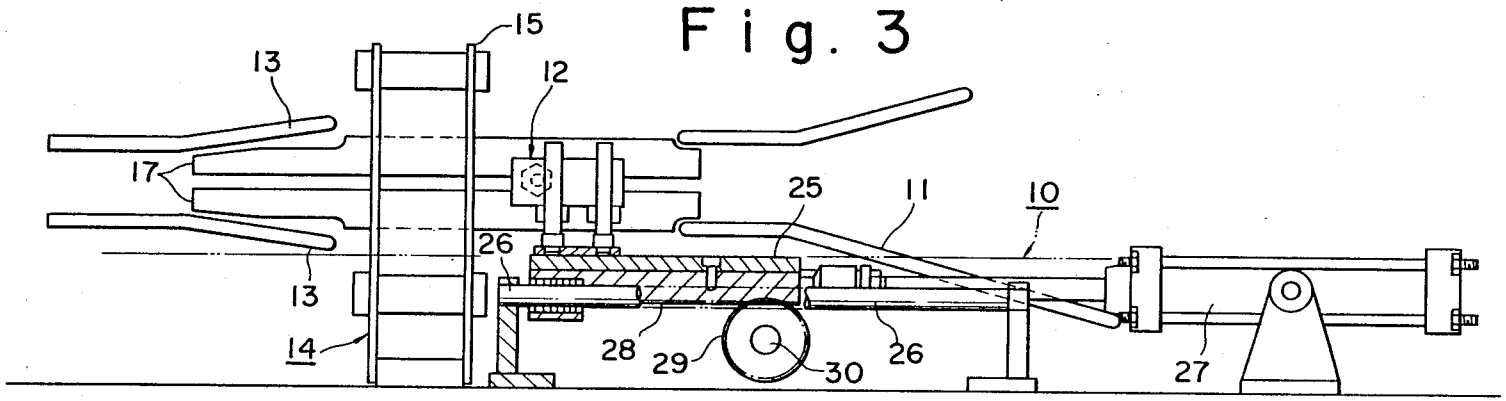
FIG. 3 is a front view of the flap gluing apparatus shown in FIG. 2.
Figure 4:
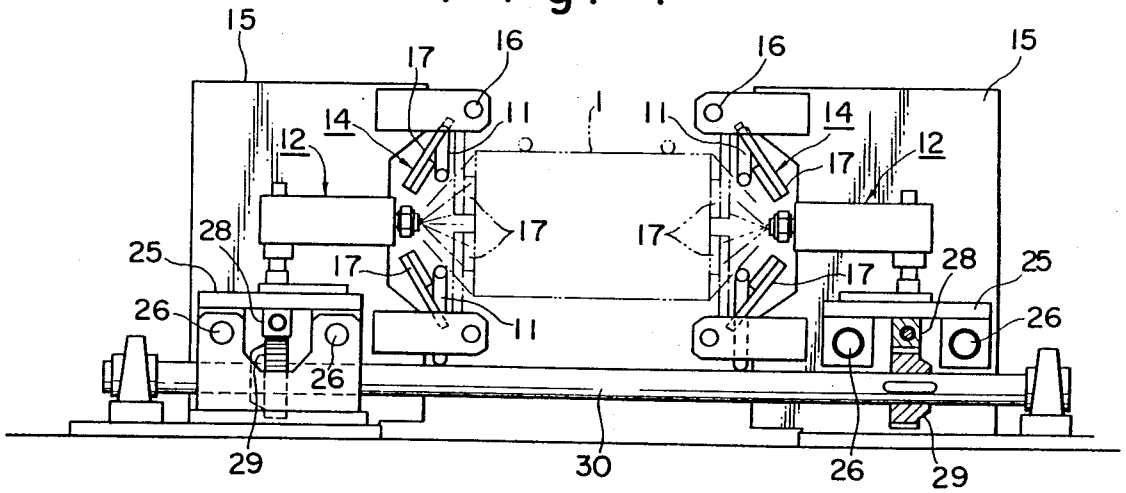
FIG. 4 is a side elevational view of the flap gluing apparatus shown in FIG. 2.

The flap gluing apparatus constructed in accordance with one embodiment of the present invention is shown in FIGS. 2 through 4. As shown, a conveyor belt 10 extends to define a path for transporting a container box 1 to be processed (from right to left in FIGS. 2 and 3). A pair of top and bottom flap folding members or rods 11 is disposed on each side of the conveyor belt 10 at the entrance of the present flap gluing apparatus. The top and bottom flap folding members 11 include inclined portions which are arranged to be convergent toward the downstream direction with respect to the direction of advancement of the conveyor belt 10. It is assumed that the container box 1 to be processed has its side flaps 4 already folded or bent in position as shown in FIG. 1 when it arrives at the entrance to the present flap gluing apparatus. Thus, as the container box 1 is transported on the conveyor belt 10, the top and bottom flaps 3 are brought into engagement with the top and bottom folding members 11 and are gradually folded toward the side flaps 4. The top and bottom flap folding members 11 also include horizontal portions which extend from the convergent ends of the inclined portions horizontally toward the downstream direction. As a result, after the top and bottom flaps 3 have been bent to a predetermined angle through engagement with the inclined portions of the flap folding members 11, they are maintained at the predetermined angle through engagement with the horizontal portions of the flap folding members 11.

Downstream of the flap folding members 11 and on each side of the conveyor belt 10 is disposed a glue applying unit 12 which is normally located at the position indicated in FIG. 2. As the container box 1 advances on the conveyor belt 10, glue is ejected from each of the glue applying units 12 and applied to the side flaps 4 through the gap between the inclined top and bottom flaps 3. As well known for one skilled in the art, a limit switch and the like may be provided along the conveyor belt 10 for detecting the presence of the container box 1 and a detection signal from the limit switch may be used to control the operation, in particular timing, of the glue applying units 12, 12.

Downstream of the glue applying units 12 and on each side of the conveyor belt 10 is disposed a second pair of top and bottom flap folding members or rods 13, which are structured similarly with the first folding members 11 and thus include inclined and horizontal portions. However, the inclined portions of the second flap folding members 13 are inclined convergently toward the downstream direction not only in a vertical plane as in the case of the first flap folding members 11 but also in a horizontal plane. Thus, the horizontal portions of the second folding members 13 are located closer to the conveyor belt 10 and at the position corresponding to the size, width or length, of the container box 1. Accordingly, as the container box 1 is transported on the conveyor belt 10, the top and bottom flaps 3 come to be pressed against the side flaps 4 on which glue has been applied so that the top and bottom flaps 3 are now adhesively affixed to the side flaps 4.

As described above, the flaps 3, 4 of each of a number of container boxes 1 can be adhesively affixed together continuously one after another while being transported on the conveyor belt 10. That is, as the container box 1 is transported, the top and bottom flaps 3 are half folded through engagement with the first flap folding members 11, glue is applied to the side flaps 4 already in folded position and then the top and bottom flaps 3 are pressed against the side flaps 4 through engagement with the second flap folding members 13 thereby having the top and bottom flaps 3 adhesively affixed to the side flaps 4. However, if the conveyor belt 10 is suddenly brought to a halt temporarily for some reason, the flaps of those container boxes 1 located between the glue applying units 12 and the second folding members 13 remain separated from each other so that the glue applied to the side flaps 4 becomes dried and thus useless in affixing the flaps. As a result, even if the top and bottom flaps 3 of those container boxes 1 come to be pressed against the side flaps 4 by the second folding members 13 when the operation of the conveyor belt 10 is resumed, the flaps 3 and 4 cannot be adhesively affixed together because the glue applied on the side flaps 4 is already dried.

Figure 5:
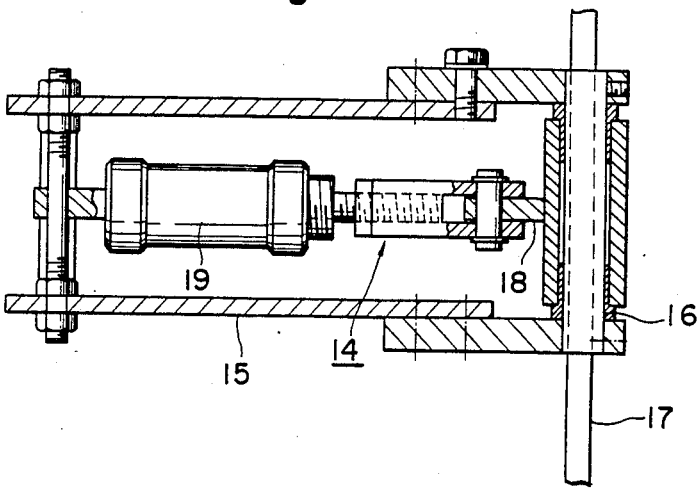
FIG. 5 is a fragmentary plan view showing on an enlarged scale a portion of the flap gluing apparatus shown in FIGS. 2 through 4.
Figure 6:
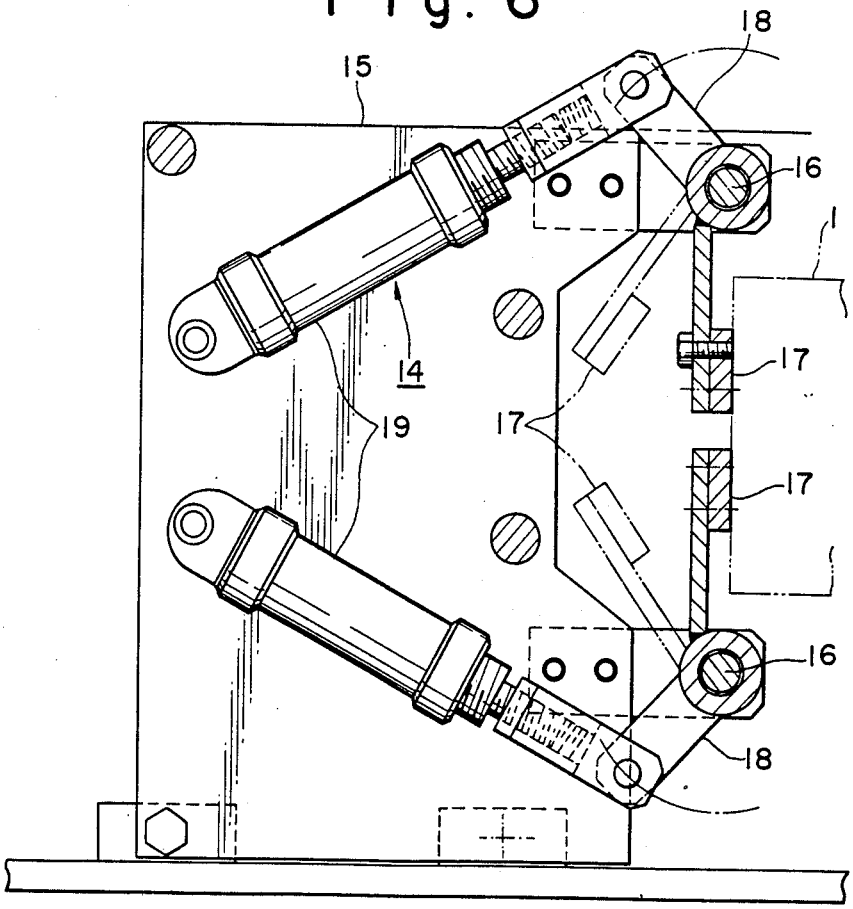
FIG. 6 is a side elevational view of the structure shown in FIG. 5.

To cope with such a situation, in the flap gluing apparatus of the present invention, flap pressing units 14 are provided one on each side of the conveyor belt 10 between the glue applying units 12 and the second flap folding members 13. Each flap pressing unit 14 includes a stationary frame 15 which is provided with a pair of top and bottom supporting shafts 16, 16 each of which pivotally and movably supports a pressure bar 17. As shown in FIG. 4, when the top and bottom pressure bars 17, 17 are pivotted around the respective supporting shafts 16, 16, they will forcibly bring the top and bottom flaps 3 into pressure contact with the side flaps 4. As shown in FIGS. 5 and 6, each of the pressure bars 17, 17 is operatively connected to a cylinder actuator 19 through an arm 18, and, thus, the pressure bar 17 may be selectively located at a retracted position separated away from the flaps of the container box 1 and at an advanced position for causing the flaps to be affixed together by means of the cylinder actuator 14. The pressure bar 17 is elongated and extends over a substantial length in parallel with the direction of advancement of the conveyor belt 10 so that two or more container boxes 1 can be processed at the same time.

Referring back to FIG. 2, it is to be noted that each of the glue applying units 12 is structured to be movable along the conveyor belt 10. With such a structure, even if the conveyor belt 10 is suddenly brought to a halt, glue can be applied properly to the side flaps 4 of container boxes 1 riding on the now stationary conveyor belt 10 by moving the glue applying units 12, 12 toward the upstream direction of the conveyor belt 10 (to the right in FIG. 2). Described more in detail, the glue applying unit 12 is fixedly mounted on a carriage 25 which rides on a pair of guide rails 26 extending on one side of and in parallel with the conveyor belt 10 so as to be movable in a reciprocating manner along the conveyor belt 10. Also provided on one side of the conveyor belt 10 is a cylinder actuator 27 which is operatively connected to the carriage 25 so that the carriage, together with the glue applying unit 12, can be moved reciprocatingly along the conveyor belt 10 by means of the cylinder actuator 27. Furthermore, a rack 28 is fixedly attached to the bottom center of the carriage 25. The rack 28 is in mesh with a pinion 29 which is fixedly provided on a driving shaft 30 which, in turn, is rotatably supported and which extends normal to the conveyor belt 10 therebelow. Accordingly, when the carriage 25 (bottom carriage 25 in FIG. 2) is caused to move along the conveyor belt 10 as driven by the cylinder actuator 27, the driving shaft 30 is driven to rotate through the rack 28 and the pinion 29 so that the pair of carriages 25, 25 one on each side of the conveyor belt 10 may be moved in unison along the conveyor belt 10.

With such a structure, under normal operating conditions, the glue applying units 12, 12 are located at the positions indicated in FIG. 2 and the pressure rods 17, 17 of the respective flap pressing units 14, 14 are held at their retracted positions. However, if the conveyor belt 10 is suddenly brought to a halt for some reason, the cylinder actuator 27 is first activated thereby causing the pair of carriages 25, 25, one on each side of the conveyor belt 10, to move in the upstream direction. The glue applying units 12, 12 eject glue to be applied to the side flaps 4 of the container boxes 1 on the conveyor belt 10, if necessary to glue a box in progress. If application of glue is not necessary, the carriages 25, 25 are still moved toward the upstream direction in unison so as not to interfere with the operation of the flap pressing units 14, 14.

As soon as the carriages 25, 25 have been moved to a predetermined position where there is no interference in operation between the carriages 25, 25 or glue applying units 12, 12 thereon and the flap pressing units 14, 14, the cylinder actuators 19, 19 are activated thereby causing the pressure bars 17, 17 to move to the advanced position, so that the top and bottom flaps 3 come to be pressed against the side flaps 4 with glue applied thereon. Since there is only a short delay in pressing the top and bottom flaps 3 against the side flaps 4 after the conveyor belt 10 has been suddenly brought to a halt, the glue applied on the side flaps 4 still retains excellent adhesivity and thus the flaps 3 and 4 can be affixed together properly as well as effectively.

It should also be noted that, as an alternative structure, one or more of the glue applying units 12 may be provided stationarily on each side of the conveyor belt 10 arranged such that they do not interfere with the operation of the flap pressing units 14, 14. It should also be noted that the first flap folding members 11 may be provided integrally with the flap pressure bars 17 as their front extensions. In this modified structure, the first flap folding members 11 move together with the corresponding pressure bars 17.

Figure 7:
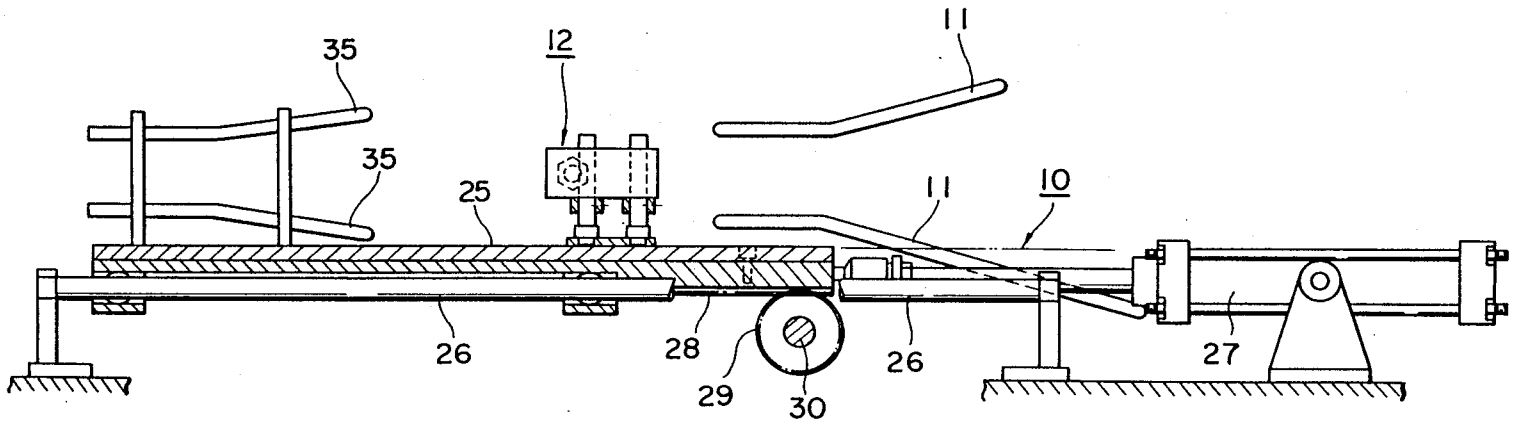
FIG. 7 is a front view showing the flap gluing apparatus constructed in accordance with another embodiment of the present invention.

FIG. 7 illustrates another embodiment of the present invention, in which second flap folding members 35 corresponding to the second flap folding members 13 in the previous embodiment are movably provided thereby allowing them to have the function of the pressure bars 17 in the previous embodiment. As shown, the second flap folding members 35 also serving as pressure bars are fixedly mounted on the carriages 25 and they remain at a predetermined position during normal operation. However, when the conveyor belt 10 is suddenly brought to a halt, the cylinder actuator 27 is activated so that the carriage 25, together with the second flap folding members 35, is forced to move in the upstream direction with respect to the advancing direction of the conveyor belt 10. As a result, the second flap folding members 35 are forcibly brought into engagement with the top and bottom flaps 3 of the container box 1 stationarily riding on the conveyor belt 10 thereby causing the top and bottom flaps 3 to be pressed against the side flaps 4 on which glue has been applied. Thus, the flaps 3 and 4, to which glue has been applied by the glue applying units 12, can be properly affixed together without the movement of the conveyor belt 10 itself.

Figure 8:
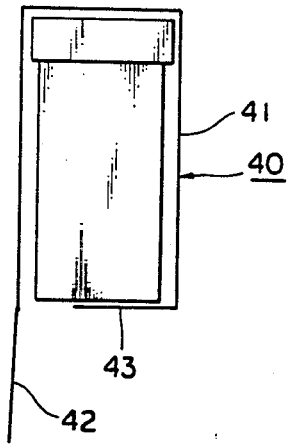
FIG. 8 is a vertical cross-sectional view showing another example of a container box having a flap to be affixed.

A further embodiment of the present invention will be described referring to FIGS. 8 through 11. FIG. 8 illustrates in cross-section another container box 40 to be processed by the present invention, which includes a rectangular main body 41 and a pair of bottom flaps 42 and 43 which are to be affixed together. In the illustrated example, the bottom flap 43 has already been folded or bent in position, and the other bottom flap 42 hangs down from the main body 41 and remains to be folded onto the bottom flap 43 in position. In this case, glue is preferably applied to the bottom flap 43 and then the bottom flap 42 is folded onto the flap 43 to be adhesively affixed together.

Figure 9:
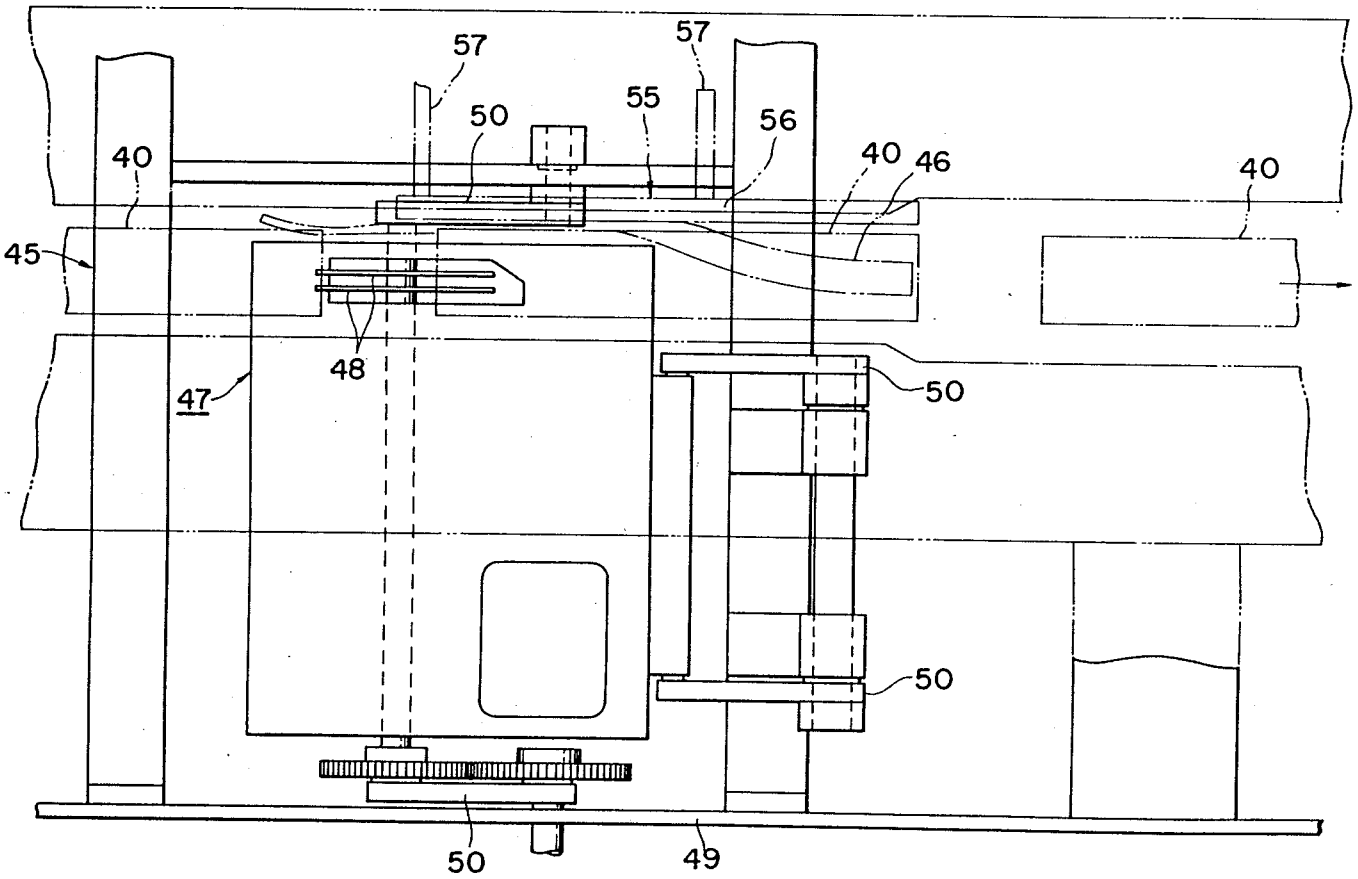
FIG. 9 is a plan view showing one embodiment of the flap gluing apparatus for processing the container box shown in FIG. 8.
Figure 10:
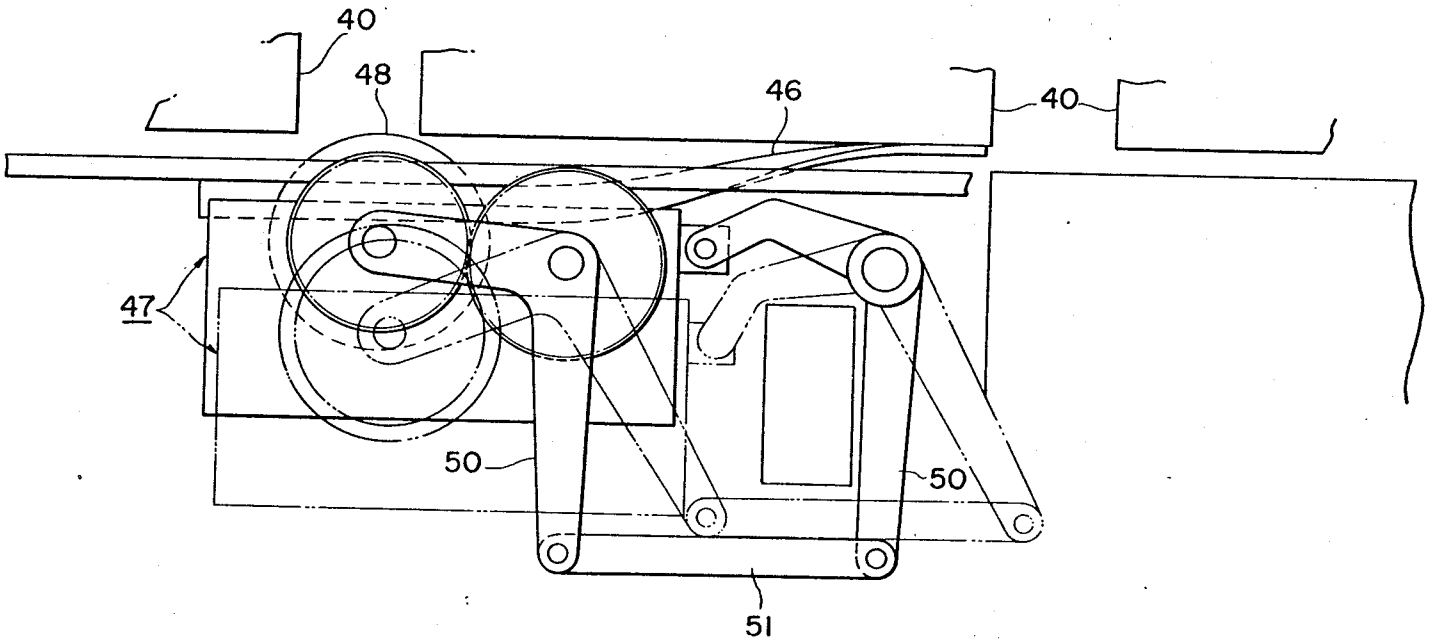
FIG. 10 is a front view of the apparatus shown in FIG. 9.
Figure 11:
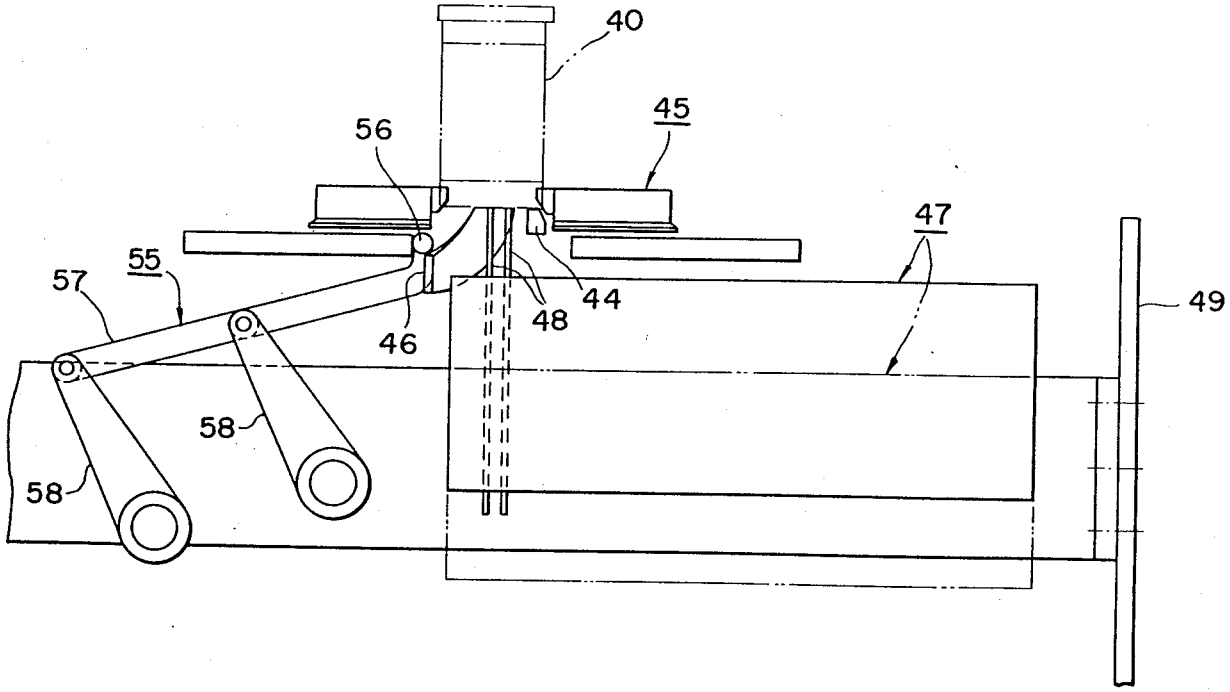
FIG. 11 is a side elevational view of the apparatus shown in FIG. 9.

Referring now to FIGS. 9 through 11, there is provided a conveyor belt 45 for transporting the boxes 40 along a box bottom guide member 44 (see FIG. 11) in the direction indicated by the arrow in FIG. 9. A flap folding member 46, having a somewhat twisted shape, is fixedly provided below the conveyor belt 45 such that it extends from a lower position at the side of the conveyor belt 45 where the hanging flap 42 of the container box 40 is located to an upper position at the center of the box 40 being transported. Thus, as the box 40 is being transported, the flap 42 comes to be brought into engagement with the twisted flap folding member 46 and thus gradually folded toward the other flap 43 in position to be finally pressed thereagainst.

Upstream of the twisted flap folding member 46 and below the conveyor belt 45 is disposed a glue applying unit 47, which is provided to be vertically movable and normally located at its elevated position as shown by the solid line in FIG. 10. The glue applying unit 47 is provided with a glue application roller 48, which is rotatably supported and brought into contact with the bottom flap 43 thereby applying glue thereto when located at the elevated position. The glue applying unit 47 is movably supported by a link mechanism including arms 50 and 51 which are pivotally supported by a frame 49. As well known for one skilled in the art, there is provided a cylinder actuator (not shown) operatively connected to the link mechanism. Thus, the glue applying unit 47 can be vertically moved between upper and lower positions by means of such a cylinder actuator. In the illustrated embodiment, even if the conveyor belt 45 is brought to a sudden halt, the operation of glue applying unit 47 is continued until the ongoing application of glue to the flap 43 by the applicator roller 48 is completed.

Also provided is a flap pressing unit 55 located generally below the conveyor belt 45 for causing the flap 42 to be pressed against the flap 43. As shown in FIGS. 9 and 11, the flap pressing unit 55 includes a pressure bar 56 located below and extending in parallel with the conveyor belt 45. The pressure bar 56 is supported at a forward end of an arm 57 which is supported by pivotal levers 58, 58. Although not shown specifically, it should be understood that at least one of the pivotal levers 58, 58 is operatively connected to a cylinder actuator. Thus, under the control of such a cylinder actuator, the pressure bar 56 can be moved between a retracted position separated away from the box 40 and its flaps 42, 43 and an advanced position where the flap 42 is pressed against the flap 43.

With the above-described structure, during normal operation, the glue applying unit 47 is located at the upper position as indicated by the solid line in FIG. 10 and the pressure rod 56 of flap pressing unit 55 is located at the retracted position. When the conveyor belt 45 is suddenly brought to a halt, the glue applying unit 47 is moved to the lower position where the glue applying unit 47 does not interfere with the operation of the flap pressing unit 55. As mentioned previously, it is so structured that glue is completely applied to the flap 43 even if the conveyor belt 45 is brought to a sudden halt.

Upon moving of the glue applying unit 47 to the lower position, the flap pressing unit 55 is set in operation so that the pressure rod 56 is moved from its retracted position to its advanced position thereby causing the flap 42 to be pressed against the flap 43. Thus, even if the conveyor belt 45 is suddenly halted, the flaps 42 and 43 of the half-processed container box 40 can be adhesively affixed properly.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claim.

What is claimed is:

1. Apparatus for adhesively affixing together an inner flap and an outer flap of a container box which when adhesively affixed together form part of one surface of said box, said surface being located in a downward orientation while said outer flap and said inner flap are being adhesively affixed, comprising:

transporting means for transporting said box along a predetermined path;

applying means disposed along said path for applying an adhesive agent to said inner flap, and means for moving said applying means to a first position beneath said box in which position said adhesive agent is applied to said inner flap and to a second position beneath said box in which position said adhesive agent is not applied;

first folding means disposed along said path downstream of said applying means for folding said outer flap against said inner flap, thereby having said inner and outer flaps adhesively affixed together; and second folding means disposed along said path adjacent said applying means for folding said outer flap affixedly against said inner flap only when said transporting means is brought to a halt, said second folding means including a pressure member, and means for moving said pressure member between a retracted position where said pressure member is held inoperative and an advanced position where said pressure member folds said outer flap said means for moving said applying means being actuated to move said applying means to said second position when said means for moving said pressure member is actuated to move said pressure member to said advanced position, thereby avoiding interference between said applying means and said pressure member;

wherein said transporting means for transporting said box along a predetermined path includes box supports located beneath that edge of said box to which said inner flap is attached, said box supports holding said inner flap in a final position while allowing for application of said adhesive agent to said inner flap, and allowing for attachment of said outer flap to said inner flap by said first folding means when said applying means is in said first position and by said second folding means when said applying means is in said second position.

* * * * *